US006951582B1

(12) United States Patent
Tsai et al.

(10) Patent No.: US 6,951,582 B1
(45) Date of Patent: Oct. 4, 2005

(54) AIR PURIFIER DEVICE

(76) Inventors: Sung-Lin Tsai, 3F, No. 7, Lane 334, Sec. 1, Wan-Shou Rd., Kuei-Shan Hsiang, Tao-Yuan Hsien (TW); Chun-Ming Wu, 2F, No. 3-1, Alley 8, Lane 242, Sec. 1, Chung-Yang Rd., Tu-Cheng City, Taipei Hsien (TW)

( * ) Notice: Subject to any disclaimer, the term of this patent is extended or adjusted under 35 U.S.C. 154(b) by 0 days.

(21) Appl. No.: 10/981,917

(22) Filed: Nov. 4, 2004

(51) Int. Cl.[7] ..... B03C 3/68

(52) U.S. Cl. ..... 96/18; 95/2; 95/6; 96/21; 96/22; 96/26; 96/65; 96/82; 96/97

(58) Field of Search ..... 96/18–24, 26, 96/63–65, 80–82, 95–97; 95/2–7

(56) References Cited

U.S. PATENT DOCUMENTS

| | | | | | |
|---|---|---|---|---|---|
| 2,783,388 | A | * | 2/1957 | Wintermute | 96/18 |
| 2,990,911 | A | * | 7/1961 | Lippincott | 96/26 |
| 3,504,482 | A | * | 4/1970 | Goettl | 96/18 |
| 3,740,926 | A | * | 6/1973 | Duval | 96/26 |
| 3,800,509 | A | * | 4/1974 | Carr et al. | 96/18 |
| 4,477,263 | A | * | 10/1984 | Shaver et al. | 95/7 |
| 4,531,402 | A | * | 7/1985 | Reif et al. | 73/28.02 |
| 4,746,331 | A | * | 5/1988 | Truce | 95/2 |
| 5,055,115 | A | * | 10/1991 | Yikai et al. | 96/59 |
| 5,061,296 | A | * | 10/1991 | Sengpiel et al. | 95/7 |
| 5,454,859 | A | * | 10/1995 | Chiba et al. | 96/18 |
| 5,656,063 | A | * | 8/1997 | Hsu | 95/58 |
| 5,702,507 | A | * | 12/1997 | Wang | 96/55 |
| 5,707,429 | A | * | 1/1998 | Lewis | 96/63 |
| 5,837,035 | A | * | 11/1998 | Braun et al. | 95/78 |
| 6,287,368 | B1 | * | 9/2001 | Ilmasti | 96/19 |
| 6,471,752 | B1 | * | 10/2002 | Lewis | 96/20 |
| 6,585,803 | B1 | * | 7/2003 | Chang et al. | 95/70 |
| 2004/0123739 | A1 | * | 7/2004 | Jan | 96/18 |

FOREIGN PATENT DOCUMENTS

| | | | | |
|---|---|---|---|---|
| JP | 54-11571 | * | 1/1979 | 96/97 |
| JP | 60-137455 | * | 7/1985 | 96/26 |

* cited by examiner

*Primary Examiner*—Richard L. Chiesa
(74) *Attorney, Agent, or Firm*—Trop, Pruner & Hu, P.C.

(57) ABSTRACT

An air purifier device includes a fan unit in an electrically conductive housing for drawing ambient air into the housing via an air inlet, and an electrically conductive dust-collecting member in the housing and disposed adjacent to an air outlet. A detecting unit is operable so as to provide a control signal in response to at least one of a change in electrical characteristics of the housing due to body contact therewith, and a change in electrical characteristics of the dust-collecting member due to excessive accumulation of dust thereon. A power control unit is operable to supply electric power to a negative ion generating unit such that a drive voltage is applied to an ionizing member of the negative ion generating unit, and is responsive to the control signal from the detecting unit to interrupt supply of the electric power to the negative ion generating unit.

4 Claims, 2 Drawing Sheets

AIR PURIFIER DEVICE

BACKGROUND OF THE INVENTION

1. Field of the Invention

The invention relates to an air purifier device, more particularly to an air purifier device having enhanced safety features.

2. Description of the Related Art

FIG. 1 illustrates a conventional air purifier device that includes a housing (not shown), which is made of an electrically conductive material, provided with a dust-collecting member 11, a fan unit 12 and a negative ion generating unit 13 therein. A mechanical switch 15 is operable to control supply of electric power to the conventional air purifier device such that the negative ion generating unit 13 can apply a drive voltage to an ionizing member 130 so that air around the ionizing member 130 is ionized to form negative ions. In such a construction, body contact with the housing can result in electrical shock. Furthermore, the condition of the dust-collecting member 11 cannot be efficiently monitored such that dust-collecting effect cannot be ensured.

SUMMARY OF THE INVENTION

Therefore, the object of the present invention is to provide an air purifier device that can eliminate the aforesaid drawbacks of the prior art.

According to the present invention, an air purifier device comprises:

a housing made of an electrically conductive material, and formed with an air inlet and an air outlet;

a fan unit mounted in the housing and disposed adjacent to the air inlet for drawing ambient air into the housing via the air inlet;

a dust-collecting member made of an electrically conductive material, mounted in the housing, and disposed adjacent to the air outlet;

a negative ion generating unit mounted in the housing and including an ionizing member that is spaced apart from the dust-collecting member, the negative ion generating unit being operable to apply a drive voltage to the ionizing member so that air around the ionizing member is ionized to form negative ions;

a detecting unit mounted in the housing and having a signal input end that is coupled electrically to the dust-collecting member and the housing, and a signal output end, the detecting unit being operable so as to provide a control signal at the signal output end in response to at least one of a change in electrical characteristics of the housing due to body contact with the housing, and a change in electrical characteristics of the dust-collecting member due to excessive accumulation of dust on the dust-collecting member; and a power control unit coupled electrically to the negative ion generating unit and the signal output end of the detecting unit, the power control unit being operable to supply electric power to the negative ion generating unit and being responsive to the control signal from the detecting unit to interrupt supply of the electric power to the negative ion generating unit.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
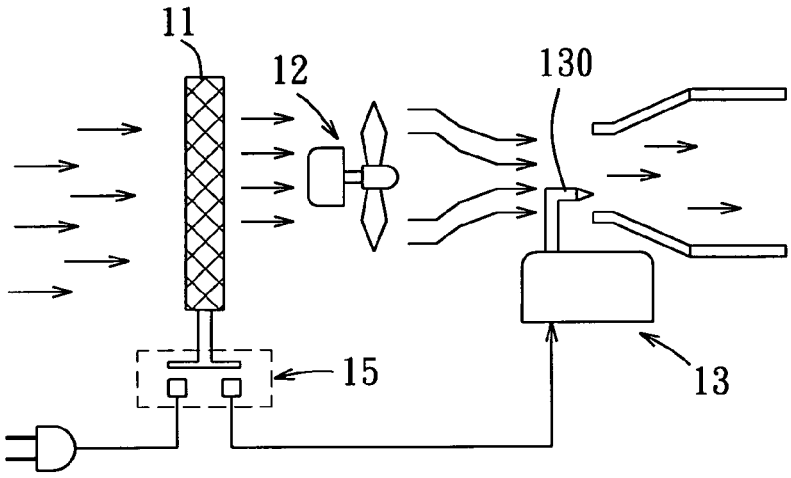
FIG. 1 PRIOR ART
FIG. 1 is a schematic view of a conventional air purifier device.
Figure 2:
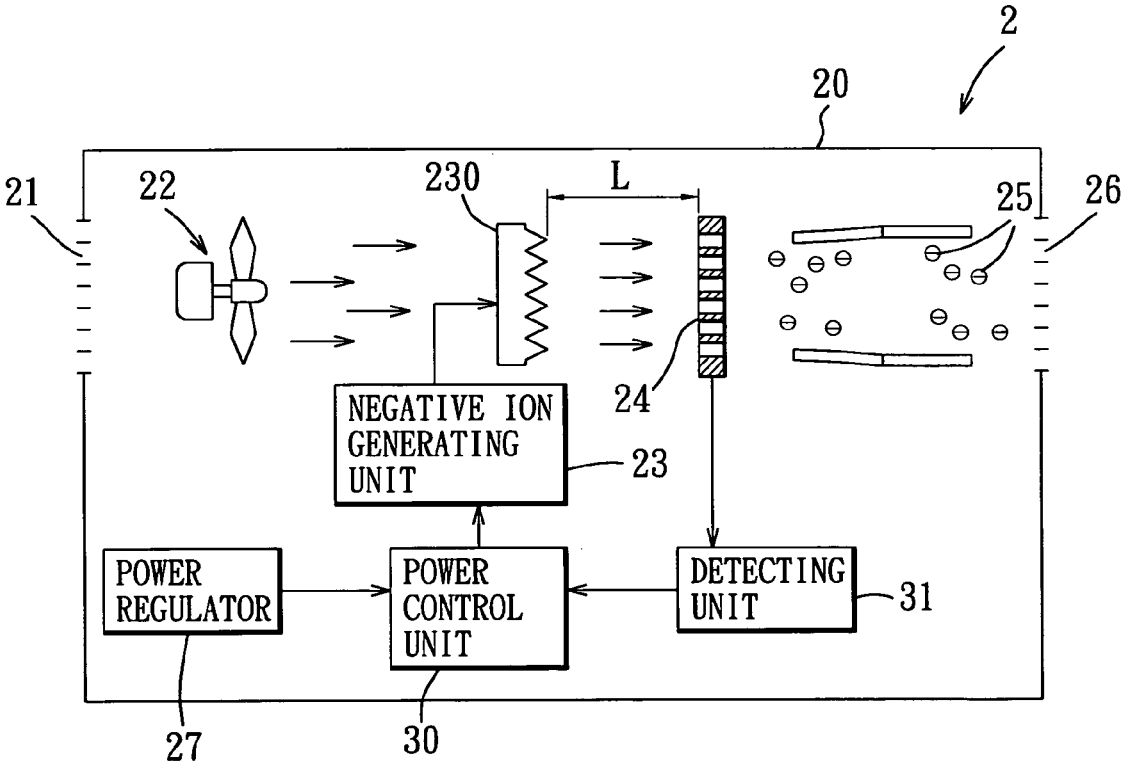
FIG. 2 is a schematic circuit block diagram illustrating the preferred embodiment of an air purifier device according to this invention.
Figure 4:
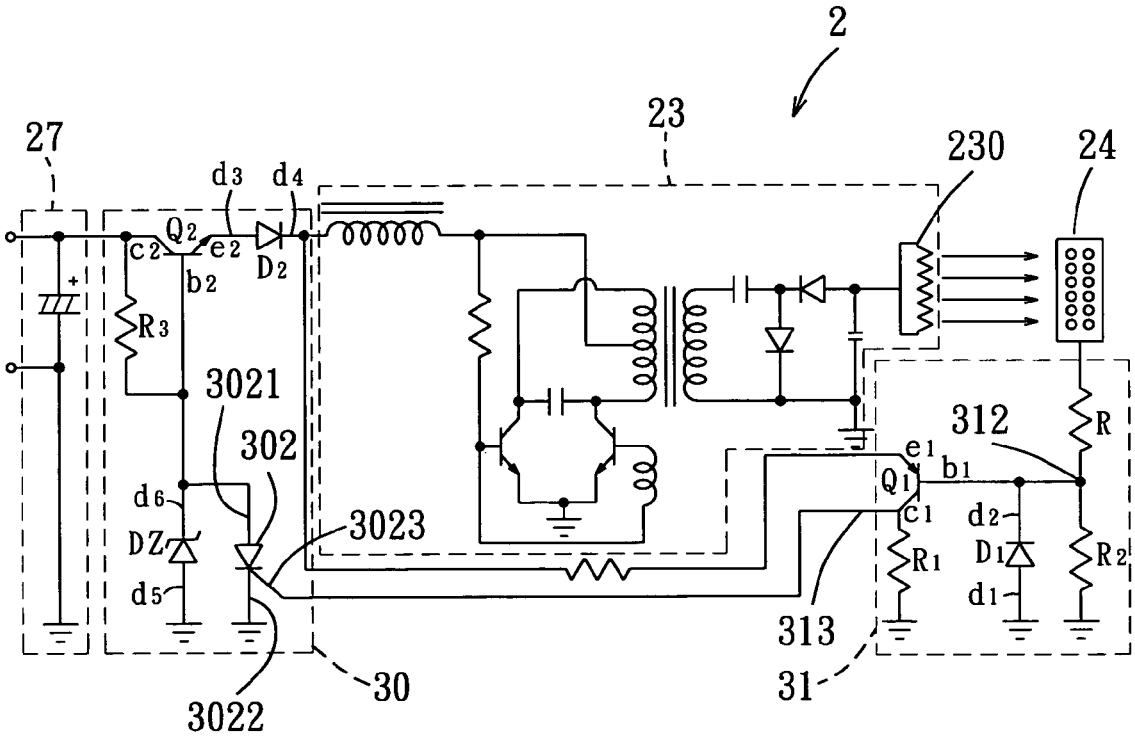
FIG. 4 is a schematic electrical circuit diagram illustrating the preferred embodiment.

Referring to FIGS. 2 and 4, the preferred embodiment of an air purifier device 2 according to the present invention is shown to include a housing 20, a fan unit 22, a dust-collecting member 24, a negative ion generating unit 23, a detecting unit 31, a power control unit 30, and a power regulator 27 connected to an input side of the power control unit 30.

The housing 20 is made of an electrically conductive material, and is formed with an air inlet 21 and an air outlet 26, as shown in FIG. 2.

The fan unit 22 is mounted in the housing 20, and is disposed adjacent to the air inlet 21 for drawing ambient air into the housing 20 via the air inlet 21, as shown in FIG. 2.

Figure 3:
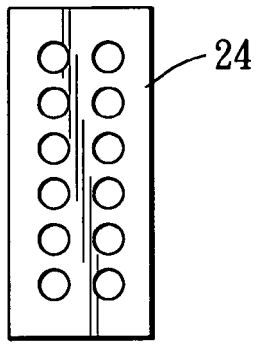
FIG. 3 is a schematic view of a dust-collecting member of the preferred embodiment.

The dust-collecting member 24 is made of an electrically conductive material, is mounted in the housing 20, and is disposed adjacent to the air outlet 26. In this embodiment, the dust-collecting member 24 includes a perforated metal plate, as best shown in FIG. 3.

The negative ion generating unit 23 is mounted in the housing 20, and includes an ionizing member 230 that is spaced apart from the dust-collecting member 24. The negative ion generating unit 23 is operable to apply a drive voltage to the ionizing member 230 in a known manner so that air around the ionizing member 230 is ionized to form negative ions 25.

The detecting unit 31 is mounted in the housing 20, and has a signal input end 312 that is coupled electrically to the dust-collecting member 24 and the housing 20, and a signal output end 313. The detecting unit 31 is operable so as to provide a control signal at the signal output end 313 in response to at least one of a change in electrical characteristics of the housing 20 due to body contact with the housing 20, and a change in electrical characteristics of the dust-collecting member 24 due to excessive accumulation of dust on the dust-collecting member 24. In this embodiment, as shown in FIG. 4, the detecting unit 31 includes a PNP transistor (Q1) having an emitter (e1), a base (b1) that serves as the signal input end 312, a collector (c1) that serves as the signal output end 313; a first diode (D1) having a grounded anode (d1), and a cathode (d2) connected to the base (b1) of the PNP transistor (Q1); a first resistor (R1) connected between the collector (c1) of the PNP transistor (Q1) and ground; and a second resistor (R2) connected to the first diode (D1) in parallel. It is noted that, the housing 20 is connected to ground in this embodiment. As such, the housing 20 is connected electrically to the signal input end 312 via the second resistor (R2), and the dust-collecting member 24 is connected electrically to the signal input end 312 via a resistor (R). With such a construction, a negative potential resulting from at least one of the above changes in the electrical characteristics of the housing 20 and the dust-collecting member 24 is applied to the base (b1) of the PNP transistor (Q1) such that the PNP transistor (Q1) is turned on. Thus, a potential of the collector (c1) of the PNP transistor (Q1) is raised from a ground level, i.e., the control signal corresponding to a relatively high potential is provided at the signal output end 313.

The power control unit 30 is coupled electrically to the negative ion generating unit 23 and the signal output end 313 of the detecting unit 31. The power control unit 30 is operable to supply electric power to the negative ion generating unit 23, and is responsive to the control signal from the detecting unit 31 to interrupt supply of the electric power to the negative ion generating unit 23. In this embodiment, the power control unit 30 includes an NPN transistor (Q2) having an emitter (e2), a base (b2) and a collector (c2); a third resistor (R3) connected across the collector (c2) and the base (b2) of the NPN transistor (Q2); a second diode (D2) having an anode (d3) connected to the emitter (e2) of the NPN transistor (Q2), and a cathode (d4) connected to the negative ion generating unit 23 and the emitter (e1) of the PNP transistor (Q1) of the detecting unit 31; a silicon controlled rectifier 302 having an anode connected to the base (b2) of the NPN transistor (Q2), a grounded cathode 3022, and a control end 3023 connected to the collector (c1) of the PNP transistor (Q1) of the detecting unit 31; and a Zener diode (DZ) having a grounded anode (d5), and a cathode (d6) connected to the base (b2) of the NPN transistor (Q2). With such a construction, when the control end 3023 of the silicon controlled rectifier 302 has yet to receive the control signal from the detecting unit 31, the NPN transistor (Q2) is turned on such that electric power is supplied to the negative ion generating unit 23. On the other hand, when the control signal generated in response to body contact with the housing 20 or excessive accumulation of dust on the dust-collecting member 24 is applied to the control end 3023 and is sufficient to cause the silicon controlled rectifier 302 to conduct, a potential of the base (b2) of the NPN transistor (Q2) is reduced, thereby turning off the NPN transistor (Q2) such that supply of the electric power to the negative ion generating unit 23 is interrupted.

To sum up, due to the detecting unit 31 and the power control unit 30, the negative ion generating unit 23 of the air purifier device 2 of this invention can be automatically shut down in the event of body contact with the housing 20 or excessive accumulation of dust on the dust-collecting member 24, thereby ensuring safety during use.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

We claim:

1. An air purifier device comprising:

a housing made of an electrically conductive material, and formed with an air inlet and an air outlet;

a fan unit mounted in said housing and disposed adjacent to said air inlet for drawing ambient air into said housing via said air inlet;

a dust-collecting member made of an electrically conductive material, mounted in said housing, and disposed adjacent to said air outlet;

a negative ion generating unit mounted in said housing and including an ionizing member that is spaced apart from said dust-collecting member, said negative ion generating unit being operable to apply a drive voltage to said ionizing member so that air around said ionizing member is ionized to form negative ions;

a detecting unit mounted in said housing and having a signal input end that is coupled electrically to said dust-collecting member and said housing, and a signal output end, said detecting unit being operable so as to provide a control signal at said signal output end in response to at least one of a change in electrical characteristics of said housing due to body contact with said housing, and a change in electrical characteristics of said dust-collecting member due to excessive accumulation of dust on said dust-collecting member; and a power control unit coupled electrically to said negative ion generating unit and said signal output end of said detecting unit, said power control unit being operable to supply electric power to said negative ion generating unit and being responsive to the control signal from said detecting unit to interrupt supply of the electric power to said negative ion generating unit.

2. The air purifier device as claimed in claim 1, wherein said dust-collecting member includes a perforated metal plate.

3. The air purifier device as claimed in claim 1, wherein:

said detecting unit includes: a PNP transistor; a first diode having a cathode connected to a base of said PNP transistor, and a grounded anode; a first resistor connected between a collector of said PNP transistor and ground; and a second resistor connected to said first diode in parallel; and said power control unit includes: an NPN transistor; a third resistor connected across a collector and a base of said NPN transistor; a second diode having an anode connected to an emitter of said NPN transistor, and a cathode connected to said negative ion generating unit and an emitter of said PNP transistor of said detecting unit; a silicon controlled rectifier having an anode connected to said base of said NPN transistor, a grounded cathode, and a control end connected to said collector of said PNP transistor of said detecting unit; and a Zener diode having a grounded anode, and a cathode connected to said base of said NPN transistor.

4. The air purifier device as claimed in claim 1, further comprising a power regulator connected to said power control unit.

* * * * *